US012396511B1

(12) United States Patent
Guan et al.

(10) Patent No.: US 12,396,511 B1
(45) Date of Patent: Aug. 26, 2025

(54) HONEYCOMB SILICONE SHOCK-ABSORBING INTEGRALLY-FORMED INSOLE

(71) Applicant: Lirong Shoes (Shenzhen) Co., Ltd., Shenzhen (CN)

(72) Inventors: Shan Guan, Shenzhen (CN); Zhen Jia, Shenzhen (CN)

( * ) Notice: Subject to any disclaimer, the term of this patent is extended or adjusted under 35 U.S.C. 154(b) by 0 days.

(21) Appl. No.: 19/009,996

(22) Filed: Jan. 4, 2025

(30) Foreign Application Priority Data

Nov. 7, 2024 (CN) ..... 202411582385.7

(51) Int. Cl.

| | |
|---|---|
| ***A43B 13/28*** | (2006.01) |
| ***A43B 1/00*** | (2006.01) |
| ***A43B 7/1425*** | (2022.01) |
| ***A43B 7/143*** | (2022.01) |
| ***A43B 7/144*** | (2022.01) |
| ***A43B 7/1445*** | (2022.01) |
| ***A43B 7/149*** | (2022.01) |
| ***A43B 9/00*** | (2006.01) |
| ***A43B 13/04*** | (2006.01) |
| ***A43B 13/12*** | (2006.01) |
| ***A43B 13/18*** | (2006.01) |
| ***A43B 13/20*** | (2006.01) |
| ***A43B 13/36*** | (2006.01) |
| ***A43B 13/38*** | (2006.01) |
| ***A43B 13/40*** | (2006.01) |
| ***A43B 23/00*** | (2006.01) |

(52) U.S. Cl.

CPC ..... *A43B 1/0009* (2013.01); *A43B 7/1425* (2013.01); *A43B 7/143* (2013.01); *A43B 7/144* (2013.01); *A43B 7/1445* (2013.01); *A43B 7/149* (2013.01); *A43B 13/04* (2013.01); *A43B 13/122* (2013.01); *A43B 13/20* (2013.01); *A43B 13/36* (2013.01); *A43B 13/386* (2013.01); *A43B 13/40* (2013.01)

(58) Field of Classification Search

None

See application file for complete search history.

(56) References Cited

U.S. PATENT DOCUMENTS 3,084,695 A * 4/1963 O'Donnell ..... A43B 7/1445 36/174

4,694,590 A * 9/1987 Greenawalt ..... A43B 7/1463 36/43

(Continued)

*Primary Examiner* — Jila M Mohandesi

(74) *Attorney, Agent, or Firm* — CAIP; Xia Li

(57) ABSTRACT

The present invention discloses a honeycomb silicone shock-absorbing integrally-formed insole, which belongs to the technical field of insoles. The honeycomb silicone shock-absorbing integrally-formed insole includes: a surface layer and a base layer that are sequentially stacked and bonded together, the base layer being provided with a connecting groove in a rear end thereof; and a silicone shock-absorbing structure that is fixedly provided with a connecting sheet at an upper end surface thereof and is fixedly provided in the connecting groove via the connecting sheet. The honeycomb silicone shock-absorbing integrally-formed insole has the following technical points. The silicone shock-absorbing structure is formed of a plurality of silicone cells each having a hexagonal shape or similar shape, and is formed with a honeycomb shock-absorbing hole.

4 Claims, 4 Drawing Sheets

(56) References Cited

U.S. PATENT DOCUMENTS

| | | | | |
|---|---|---|---|---|
| 6,176,025 | B1 * | 1/2001 | Patterson | A43B 7/1445 36/35 B |
| 6,453,578 | B1 * | 9/2002 | Yung | A43B 7/22 36/43 |
| 7,380,353 | B2 * | 6/2008 | Feller | A43B 7/144 36/76 R |
| 7,614,163 | B2 * | 11/2009 | Fujii | A43B 7/1445 36/43 |
| 8,250,784 | B2 * | 8/2012 | Cheskin | A43B 7/1415 36/144 |
| 9,961,958 | B1 * | 5/2018 | Granger | A43B 7/143 |
| 2004/0181971 | A1 * | 9/2004 | Turkbas | A61F 5/14 36/88 |
| 2004/0194344 | A1 * | 10/2004 | Tadin | A43B 7/144 36/173 |
| 2005/0166425 | A1 * | 8/2005 | Seiter | A43B 7/145 36/28 |
| 2009/0049712 | A1 * | 2/2009 | Steszyn | A43B 7/1445 36/71 |
| 2010/0306894 | A1 * | 12/2010 | Calvert | A43B 7/1445 2/24 |
| 2011/0000101 | A1 * | 1/2011 | Nakano | A43B 7/148 12/146 B |
| 2015/0237959 | A1 * | 8/2015 | Wynn | A43B 7/1435 12/146 M |

* cited by examiner

HONEYCOMB SILICONE SHOCK-ABSORBING INTEGRALLY-FORMED INSOLE

CROSS REFERENCE TO RELATED APPLICATIONS

The present application claims the priority of Chinese patent application No. 2024115823857, filed on Nov. 7, 2024, and contents of which are incorporated herein by reference.

BACKGROUND OF THE INVENTION

Field of the Invention

The present invention relates to the technical field of insoles, and in particular to a honeycomb silicone shock-absorbing integrally-formed insole.

Description of Related Art

An insole is a part of a shoe that is in closest contact with a foot, and the insole is located inside the shoe and is in direct contact with a sole of the foot. As an important accessory of footwear, the insole plays an important role in improving comfort, supporting feet, protecting shoes, and the like.

Patent Publication No. CN207341286U discloses an insole. According to the invention, when a frame and a filling block are connected by a cord during a manufacturing process, a connection speed is fast and knots are less, which greatly improves the production efficiency of the insole, and the cord is hidden in a threading hole and a threading groove, so that the cord is not easy to wear and break, which prolongs the service life of the insole. This invention can be used as an insole directly put into a shoe for use, and can also be used as a shoe upper sole to fix the frame above a midsole during a shoemaking process.

However, the above-mentioned insole has deficiencies in terms of shock-absorbing performance, especially in a heel portion, which often cannot provide sufficient supporting and shock-absorbing effects, causing a wearer to feel fatigue and discomfort when walking or exercising for a long time. In addition, most of the existing shock-absorbing silicone insoles adopt a multi-layer composite structure, which not only makes processing complicated but also makes the insoles prone to delamination and falling off, affecting use experience and the service life of the insole. Therefore, in view of the above-mentioned problems, a honeycomb silicone shock-absorbing integrally-formed insole is proposed.

SUMMARY OF THE INVENTION

A technical problem to be solved by the present invention is to provide a honeycomb silicone shock-absorbing integrally-formed insole. The insole is provided with a silicone shock-absorbing structure at a heel central portion thereof. The silicone shock-absorbing structure is formed of a plurality of silicone cells each having a hexagonal shape or similar shape, and is formed with a honeycomb shock-absorbing hole. When wearing and walking, an air column is formed in the shock-absorbing hole to play a supporting and shock-absorbing role, and a silicone material can also provide a good shock-absorbing effect, and can effectively absorb and disperse an impact force generated during walking or exercising, and play a good protective role for the heel. In addition, an insole body is formed by bonding a surface layer and a base layer together, and the structure is relatively simple, it is possible to ensure stability and durability of the insole structure, and solve the technical problems that the insole in the prior art often cannot provide sufficient supporting and shock-absorbing effects for the heel portion, and the shock-absorbing insole formed of the multi-layer composite structure is prone to delamination and falling off.

In an embodiment of this application, the following technical solution is used to resolve the technical problems.

A honeycomb silicone shock-absorbing integrally-formed insole includes a surface layer and a base layer that are sequentially stacked and bonded together, so that the insole has a high degree of integration and a relatively simple structure, and the stability and durability of the insole structure can be ensured. The base layer is provided with a connecting groove in a rear end thereof. The honeycomb silicone shock-absorbing integrally-formed insole further includes a silicone shock-absorbing structure that is fixedly provided with a connecting sheet at an upper end surface thereof and is fixedly provided in the connecting groove via the connecting sheet. The connecting sheet plays a connecting medium role and provides a basis for the detachable connection between the base layer and the silicone shock-absorbing structure. The silicone shock-absorbing structure is formed of a plurality of silicone cells each having a hexagonal shape or similar shape, and is formed with a honeycomb shock-absorbing hole. When wearing and walking, an air column is formed in the shock-absorbing hole to play a supporting and shock-absorbing role, and a silicone material can also provide a good shock-absorbing effect, and can effectively absorb and disperse an impact force generated during walking or exercising, and play a good protective role for a heel.

In a possible implementation, the surface layer includes a heel cushion block, an arch cushion block, and a sole cushion block sequentially provided from rear to front, and further includes a supplementary cushion block provided on a side surface of the sole cushion block. The heel cushion block, the arch cushion block, the sole cushion block, and the supplementary cushion block can support a heel, an arch, a sole joint, and a sole edge, respectively, so that the surface layer fits a sole of a foot better, thereby improving the comfort during use. In addition, the heel cushion block, the arch cushion block, the sole cushion block, and the supplementary cushion block are bonded together via a connecting fabric. By the connecting fabric, position angles of the heel cushion block, the arch cushion block, the sole cushion block, and the supplementary cushion block can be changed relatively, thereby further improving the fit with the foot.

In a possible implementation, the connecting groove is pasted with a Velcro loop surface at a bottom thereof, the connecting sheet is fixedly pasted with a Velcro hook surface at an upper end surface thereof, and the connecting sheet is bonded in the connecting groove via a Velcro structure. Through the above-mentioned structural form, the detachable bonding between the connecting sheet and the connecting groove can be achieved, thereby facilitating the disassembly and assembly of the silicone shock-absorbing structure and facilitating the separate replacement of the silicone shock-absorbing structure.

In a possible implementation, the shock-absorbing hole is plugged with a silicone insert block, the silicone insert block can play a supporting and shaping role for the shock-absorbing hole, so that the shock-absorbing hole can be more uniform when transmitting force under pressure and is not easily deformed due to pressure, which makes the shock-absorbing hole unable to be used normally. After the silicone insert block is completely inserted into the shock-absorbing hole, a lower end surface of the silicone insert block is flush with a lower end surface of the silicone shock-absorbing structure, and this structural form can avoid a situation where the silicone insert block bulges outward, causing the silicone shock-absorbing structure to be unstable in contact with a shoe sole.

In a possible implementation, the silicone insert block includes a silicone platform having a hexagonal platform shape, and a lower end surface of the silicone platform is hermetically connected with a bottom cover. The bottom cover can increase a contact area between the silicone shock-absorbing structure and the shoe sole, making it difficult for the silicone shock-absorbing structure and the shoe sole to shake relative to each other, and can also prevent the silicone shock-absorbing structure from leaving a hexagonal indentation on the shoe sole. In addition, the bottom cover is provided with an air vent hole therethrough, and the air vent hole can allow air to enter the shock-absorbing hole to form a shock-absorbing air column.

In a possible implementation, the silicone platform is fixedly provided with a centrally arranged reinforcing rib on each inner wall thereof, and the reinforcing rib is made of a silicone material and has a semicircular cross-section. The reinforcing rib can improve the deformation resistance of the silicone platform, thereby ensuring that the silicone platform is not easily deformed after long-term use and can still maintain a close fit with the shock-absorbing hole.

In summary, the present invention has the following beneficial technical effects.

The insole is provided with the silicone shock-absorbing structure at a heel central portion thereof. The silicone shock-absorbing structure is formed of the plurality of silicone cells each having a hexagonal shape or similar shape, and is formed with the honeycomb shock-absorbing hole. When wearing and walking, the air column is formed in the shock-absorbing hole to play the supporting and shock-absorbing role, and the silicone material can also provide the good shock-absorbing effect, and can effectively absorb and disperse the impact force generated during the walking or exercising, and play the good protective role for the heel.

In addition, an insole body is formed by bonding the surface layer and the base layer together, and the structure is relatively simple, it is possible to ensure the stability and durability of the insole structure, and it is not easy for the insole body to be delaminated and fall off.

BRIEF DESCRIPTION OF THE DRAWINGS

The accompanying drawings are used to provide a further understanding of the present invention and constitute a part of the specification, and the accompanying drawings, together with an embodiment of the present invention, are used to describe the present invention and do not limit the present invention.

REFERENCE SIGNS LIST

1: surface layer, 11: heel cushion block, 12: arch cushion block, 13: sole cushion block, 14: supplementary cushion block, 15: connecting fabric, 2: base layer, 21: connecting groove, 22: Velcro loop surface, 3: connecting sheet, 31: Velcro hook surface, 4: silicone shock-absorbing structure, 41: shock-absorbing hole, 5: silicone insert block, 51: silicone platform, 52: bottom cover, 53: air vent hole, 54: reinforcing rib.

DETAILED DESCRIPTION OF THE INVENTION

In order to solve the problems in the above-mentioned background art, technical solutions in an embodiment of this application have the following general idea.

Figure 1:
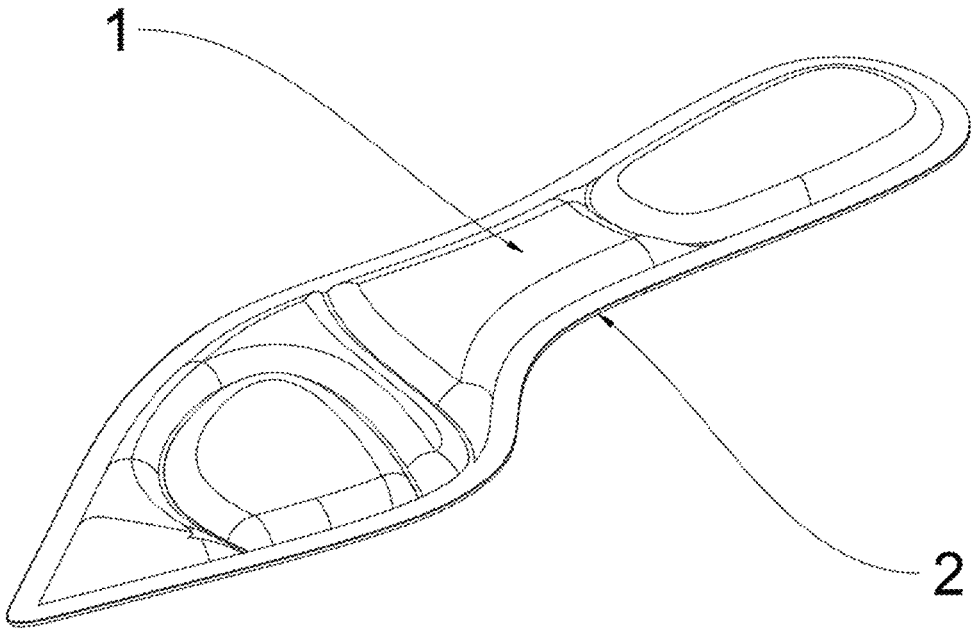
FIG. 1 is a schematic diagram of an overall structure of the present invention.
Figure 2:
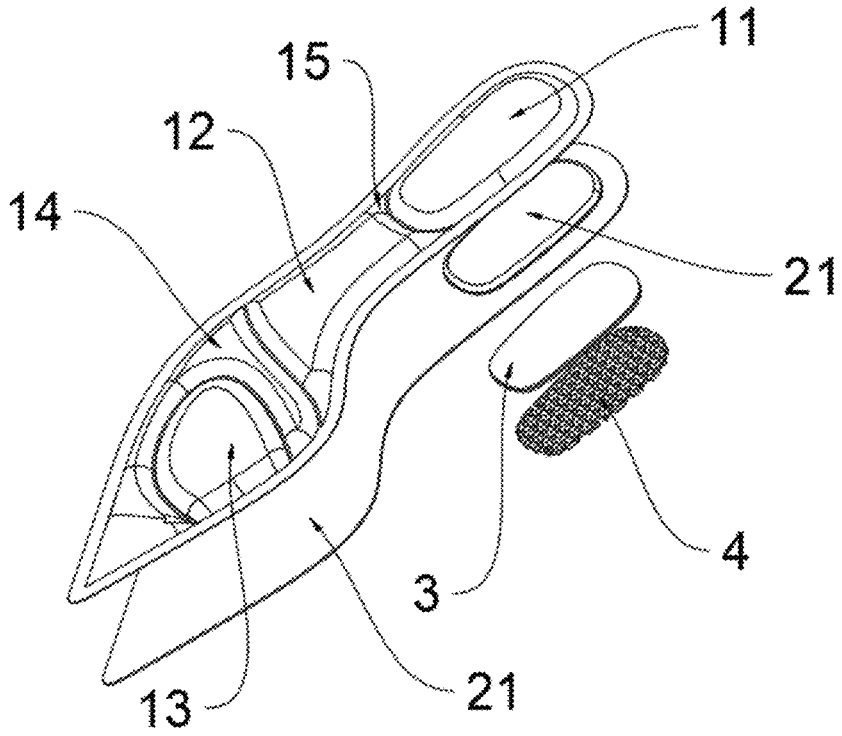
FIG. 2 is a schematic diagram of structural components of the present invention.
Figure 3:
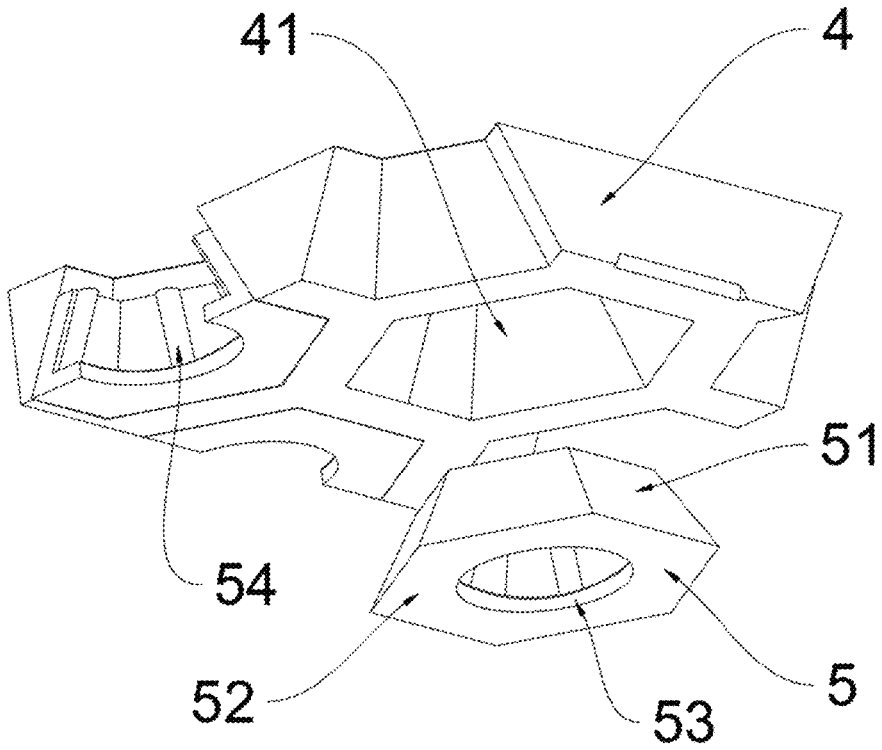
FIG. 3 is a schematic diagram of a shock-absorbing structure of the present invention.

As shown in FIGS. 1 to 3, a honeycomb silicone shock-absorbing integrally-formed insole according to the present embodiment includes a surface layer 1 and a base layer 2 that are sequentially stacked and bonded together, so that the insole has a high degree of integration and a relatively simple structure, and the stability and durability of the insole structure can be ensured. The base layer 2 is provided with a connecting groove 21 in a rear end thereof. The honeycomb silicone shock-absorbing integrally-formed insole further includes a silicone shock-absorbing structure 4 that is fixedly provided with a connecting sheet 3 at an upper end surface thereof and is fixedly provided in the connecting groove 21 via the connecting sheet 3. The connecting sheet 3 plays a connecting medium role and provides a basis for the detachable connection between the base layer 2 and the silicone shock-absorbing structure 4.

The silicone shock-absorbing structure 4 is formed of a plurality of silicone cells each having a hexagonal shape or similar shape, and is formed with honeycomb shock-absorbing holes 41. When wearing and walking, an air column is formed in each of the shock-absorbing holes 41 to play a supporting and shock-absorbing role, and a silicone material can also provide a good shock-absorbing effect, and can effectively absorb and disperse an impact force generated during walking or exercising, and play a good protective role for a heel.

As shown in FIG. 2, the surface layer 1 includes a heel cushion block 11, an arch cushion block 12, and a sole cushion block 13 sequentially provided from rear to front, and further includes a supplementary cushion block 14 provided on a side surface of the sole cushion block 13. The heel cushion block 11, the arch cushion block 12, the sole cushion block 13, and the supplementary cushion block 14 can support a heel, an arch, a sole joint, and a sole edge, respectively, so that the surface layer 1 fits a sole of a foot better, thereby improving the comfort during use. In addition, the heel cushion block 11, the arch cushion block 12, the sole cushion block 13, and the supplementary cushion block 14 are bonded together via a connecting fabric 15. By the connecting fabric 15, position angles of the heel cushion block 11, the arch cushion block 12, the sole cushion block 13, and the supplementary cushion block 14 can be changed relatively, thereby further improving the fit with the foot.

Figure 4:
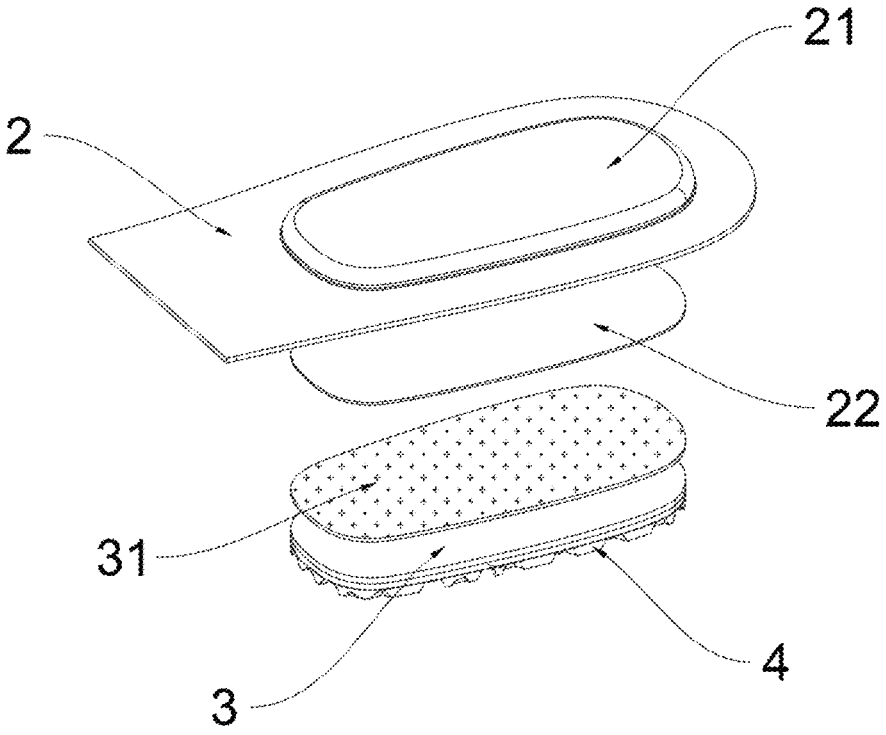
FIG. 4 is a schematic diagram of a connecting structure of a silicone shock-absorbing structure of the present invention.

As shown in FIG. 4, the connecting groove 21 is pasted with a Velcro loop surface 22 at a bottom thereof, the connecting sheet 3 is fixedly pasted with a Velcro hook surface 31 at an upper end surface thereof, and the connecting sheet 3 is bonded in the connecting groove 21 via a Velcro structure. Through the above-mentioned structural form, the detachable bonding between the connecting sheet 3 and the connecting groove 21 can be achieved, thereby facilitating the disassembly and assembly of the silicone shock-absorbing structure 4 and facilitating the separate replacement of the silicone shock-absorbing structure 4.

As shown in FIG. 3, the shock-absorbing hole 41 is plugged with a silicone insert block 5, the silicone insert block 5 can play a supporting and shaping role for the shock-absorbing hole 41, so that the shock-absorbing hole 41 can be more uniform when transmitting force under pressure and is not easily deformed due to pressure, which makes the shock-absorbing hole 41 unable to be used normally. After the silicone insert block 5 is completely inserted into the shock-absorbing hole 41, a lower end surface of the silicone insert block 5 is flush with a lower end surface of the silicone shock-absorbing structure 4, and this structural form can avoid a situation where the silicone insert block 5 bulges outward, causing the silicone shock-absorbing structure 4 to be unstable in contact with a shoe sole.

The silicone insert block 5 includes a silicone platform 51 having a hexagonal platform shape, and a lower end surface of the silicone platform 51 is hermetically connected with a bottom cover 52. The bottom cover 52 can increase a contact area between the silicone shock-absorbing structure 4 and the shoe sole, making it difficult for the silicone shock-absorbing structure 4 and the shoe sole to shake relative to each other, and can also prevent the silicone shock-absorbing structure 4 from leaving a hexagonal indentation on the shoe sole. In addition, the bottom cover 52 is provided with an air vent hole 53 therethrough, and the air vent hole 53 can allow air to enter the shock-absorbing hole 41 to form a shock-absorbing air column.

In addition, the silicone platform 51 is fixedly provided with a centrally arranged reinforcing rib 54 on each inner wall thereof, and the reinforcing rib 54 is made of a silicone material and has a semicircular cross-section. The reinforcing rib 54 can improve the deformation resistance of the silicone platform 51, thereby ensuring that the silicone platform 51 is not easily deformed after long-term use and can still maintain a close fit with the shock-absorbing hole 41.

The present invention has the following use principle and use process.

The insole is provided with the silicone shock-absorbing structure 4 at a heel central portion thereof. The silicone shock-absorbing structure 4 is formed of the plurality of silicone cells each having a hexagonal shape or similar shape, and is formed with the honeycomb shock-absorbing holes 41. When wearing and walking, the air column is formed in each of the shock-absorbing holes 41 to play the supporting and shock-absorbing role, and the silicone material can also provide the good shock-absorbing effect, and can effectively absorb and disperse the impact force generated during the walking or exercising, and play the good protective role for the heel.

In addition, an insole body is formed by bonding the surface layer 1 and the base layer 2 together, and the structure is relatively simple, it is possible to ensure the stability and durability of the insole structure, and it is not easy for the insole body to be delaminated and fall off.

In addition, the shock-absorbing hole 41 is plugged with the silicone insert block 5, and the silicone insert block 5 includes the silicone platform 51 having a hexagonal platform shape, the lower end surface of the silicone platform 51 is hermetically connected with the bottom cover 52. The bottom cover 52 can increase the contact area between the silicone shock-absorbing structure 4 and the shoe sole, making it difficult for the silicone shock-absorbing structure 4 and the shoe sole to shake relative to each other, and can also prevent the silicone shock-absorbing structure 4 from leaving a hexagonal indentation on the shoe sole. The bottom cover 52 is provided with the air vent hole 53 therethrough, and the air vent hole 53 can allow the air to enter the shock-absorbing hole 41 to form the shock-absorbing air column.

Finally, it should be noted that: obviously, the above-mentioned embodiment is merely an example for clearly explaining the present invention, and is not intended to limit the implementations. For those having ordinary skills in the art, other different forms of changes or modifications can be made based on the above description. An exhaustive list of all implementations is neither necessary nor possible here. The obvious changes or modifications derived therefrom are still within the protection scope of the present invention.

The present invention discloses a honeycomb silicone shock-absorbing integrally-formed insole, which belongs to the technical field of insoles. The honeycomb silicone shock-absorbing integrally-formed insole includes: a surface layer and a base layer that are sequentially stacked and bonded together, the base layer being provided with a connecting groove in a rear end thereof; and a silicone shock-absorbing structure that is fixedly provided with a connecting sheet at an upper end surface thereof and is fixedly provided in the connecting groove via the connecting sheet. The honeycomb silicone shock-absorbing integrally-formed insole has the following technical points. The silicone shock-absorbing structure is formed of a plurality of silicone cells each having a hexagonal shape or similar shape, and is formed with a honeycomb shock-absorbing hole. When wearing and walking, an air column is formed in the shock-absorbing hole to play a supporting and shock-absorbing role, and a silicone material can also provide a good shock-absorbing effect, and can effectively absorb and disperse an impact force generated during walking or exercising, and play a good protective role for a heel. In addition, an insole body is formed by bonding the surface layer and the base layer together, and the structure is relatively simple, and it is possible to ensure stability and durability of the insole structure.

What is claimed is:

1. A honeycomb silicone shock-absorbing integrally-formed insole, comprising:

a surface layer (1) and a base layer (2) that are sequentially stacked and bonded together, the base layer (2) being provided with a connecting groove (21) in a rear end thereof; and a silicone shock-absorbing structure (4) that is fixedly provided with a connecting sheet (3) at an upper end surface thereof and is fixedly provided in the connecting groove (21) via the connecting sheet (3), wherein the silicone shock-absorbing structure (4) is formed of a plurality of silicone cells each having a hexagonal shape, and is formed with a honeycomb shock-absorbing hole (41), and the surface layer (1) includes a heel cushion block (11), an arch cushion block (12), and a sole cushion block (13) sequentially provided from rear to front, and further includes a supplementary cushion block (14) provided on a side surface of the sole cushion block (13), and the heel cushion block (11), the arch cushion block (12), the sole cushion block (13), and the supplementary cushion block (14) are bonded together via a connecting fabric (15);

wherein the shock-absorbing hole (41) is plugged with a silicone insert block (5), and after the silicone insert block (5) is completely inserted into the shock-absorbing hole (41), a lower end surface of the silicone insert block (5) is flush with a lower end surface of the silicone shock-absorbing structure (4).

2. The honeycomb silicone shock-absorbing integrally-formed insole according to claim 1, wherein the connecting groove (21) is connected with a loop surface (22) at a bottom thereof, the connecting sheet (3) is fixedly connected with a hook surface (31) at an upper end surface thereof, and the connecting sheet (3) is bonded in the connecting groove (21) via a combination of loop surface (22) and hook surface (31).

3. The honeycomb silicone shock-absorbing integrally-formed insole according to claim 1, wherein the silicone insert block (5) includes a silicone platform (51) having a hexagonal platform shape, a lower end surface of the silicone platform (51) is hermetically connected with a bottom cover (52), and the bottom cover (52) is provided with an air vent hole (53) therethrough.

4. The honeycomb silicone shock-absorbing integrally-formed insole according to claim 3, wherein the silicone platform (51) is fixedly provided with a centrally arranged reinforcing rib (54) on each inner wall thereof, and the reinforcing rib (54) is made of a silicone material and has a semicircular cross-section.

* * * * *